United States Patent [19]

Bucy, Jr.

[11] 3,967,258

[45] June 29, 1976

[54] ALARM SYSTEM

[75] Inventor: J. Fred Bucy, Jr., Dallas, Tex.

[73] Assignee: Texas Instruments, Dallas, Tex.

[22] Filed: Aug. 6, 1973

[21] Appl. No.: 386,134

[52] U.S. Cl. ..... 340/258 B; 250/338; 340/224; 340/249; 340/409

[51] Int. Cl.[2] ..... G08B 13/18

[58] Field of Search ..... 340/224, 258 B, 249, 340/409, 416; 307/311, 312; 250/338

[56] References Cited

UNITED STATES PATENTS

| | | | |
|---|---|---|---|
| 1,992,199 | 2/1935 | Gerald | 340/258 B |
| 2,899,674 | 8/1959 | Sierer | 340/224 |
| 3,329,946 | 7/1967 | Robbins | 340/258 B |
| 3,529,164 | 9/1970 | Komatsubara et al. | 250/338 X |
| 3,534,351 | 10/1970 | Harnden et al. | 340/258 B |
| 3,594,751 | 7/1971 | Ogden et al. | 340/249 X |
| 3,618,067 | 11/1971 | Devale et al. | 340/224 X |
| 3,619,629 | 11/1971 | Matthews | 340/258 B |
| 3,631,433 | 12/1971 | Dix | 340/409 |
| 3,725,887 | 4/1973 | Sneider | 340/224 |
| 3,786,460 | 1/1974 | Kaltenbach | 340/224 |

*Primary Examiner*—David L. Trafton
*Attorney, Agent, or Firm*—Harold Levine; Edward J. Connors, Jr.; John G. Graham

[57] ABSTRACT

A system for detecting intruders in a building, using sets of light emitters and detectors. Interruption of a beam between an emitter and a detector produces a radio signal picked up by a control console. The system is easily installed because the emitters and detectors are battery powered, requiring no connection to house wiring, and the radio link between detectors and the control console avoids wiring for the signal circuit.

8 Claims, 6 Drawing Figures

ALARM SYSTEM

BACKGROUND OF THE INVENTION

An increasing need exists for detector and alarm systems for protecting homes, stores, schools and the like from intruders. Burglar alarms have been available for many years, but cost and inconvenient operating features make the systems beyond the range of feasibility for buildings other than substantial business establishments or expensive homes. High labor costs make it increasingly difficult to provide guards and patrol services, and even at high cost these services are not always effective.

One of the major factors entering into the cost of a conventional burglar alarm system is the cost of installation. For example, an alarm system based on the use of photoelectric cells and light sources as the detection means would require a light source and photocell for each window or door of a building, or at least for each exterior wall having one or more windows or doors. Each of these sources and photocells would require connection to house wiring for power, and each cell would require a connection to a control alarm box or some type of monitoring system. The same sort of wiring or installation job would be needed for a system based on use of various other electrical detectors such as conductive tape on windows, switches on doors, etc. In any of these cases, the wiring job alone might cost many hundreds or even thousands of dollars, aside from the cost of the components of the system.

When component and installation costs become the major consideration in system design, then classically the reliability of the system suffers. For burglar alarms, one particularly annoying factor in a low quality system is that of false alarms. If the detectors of the system have a reasonably low threshold, i.e., the system is reasonably sensitive as it must be to be effective, then it follows that routine changes such as supply voltage variations, aging, etc., can cause false alarms. This difficulty with false indications is particularly troublesome if battery operated units are used to avoid house wiring.

It is accordingly a principal feature of this invention to provide a low cost, easily installed protection system or intrusion detector and alarm system for buildings such as homes or small businesses. Another feature is providing a burglar alarm type system which may be installed without connection to house wiring. Also, a feature is providing a battery operated surveillance system of the type described which is sensitive yet relatively free from false alarms caused by low battery voltage and the like.

BRIEF SUMMARY OF THE INVENTION

According to an illustrative embodiment of the invention, a protection or surveillance system is provided which uses a large number of sets or pairs of emitters and detectors, each pair monitoring a given area such as one exterior wall in one room of a building where there may be one or more windows or doors for possible ingress by an intruder. The emitter generates a beam which is directed to the detector; in a preferred embodiment the beam is produced by an infrared light emitter such as a GaAs radiant diode. The detector is responsive to the infrared beam, and produces an electrical indication when the beam is interrupted along the line-of-sight between the emitter and detector. This indication is used to alter the signal of a transmitter associated with the detector; the signals transmitted by all of the detectors are monitored by a central console which has an antenna laid out in the form of a simple wire or loop in the attic or overhead, or in the crawl space under the building. The antenna is of a type which may be very easily installed without expenditure of time and effort in wiring. The emitters and detectors are in small, inexpensive, self-contained packages which need not be connected to house wiring. The central console functions to sense changes in the transmitted signals to produce an indication that one of the beams has been interrupted or that one of the detectors is not functioning or battery voltage is low. If a true indication is received, i.e., a beam has been interrupted, then an alarm is sounded, or lights are flashed on, or other action is taken such as an automatic telephone dialer being actuated to alert police or a patrol service.

THE DRAWINGS

Novel features believed characteristic of the invention are set forth in the appended claims. The invention itself, however, as well as other objects and advantages thereof, may best be understood by reference to the following detailed description of illustrative embodiments, read in conjunction with the accompanying drawings, wherein:

DETAILED DESCRIPTION OF SPECIFIC EMBODIMENTS

Figure 1:
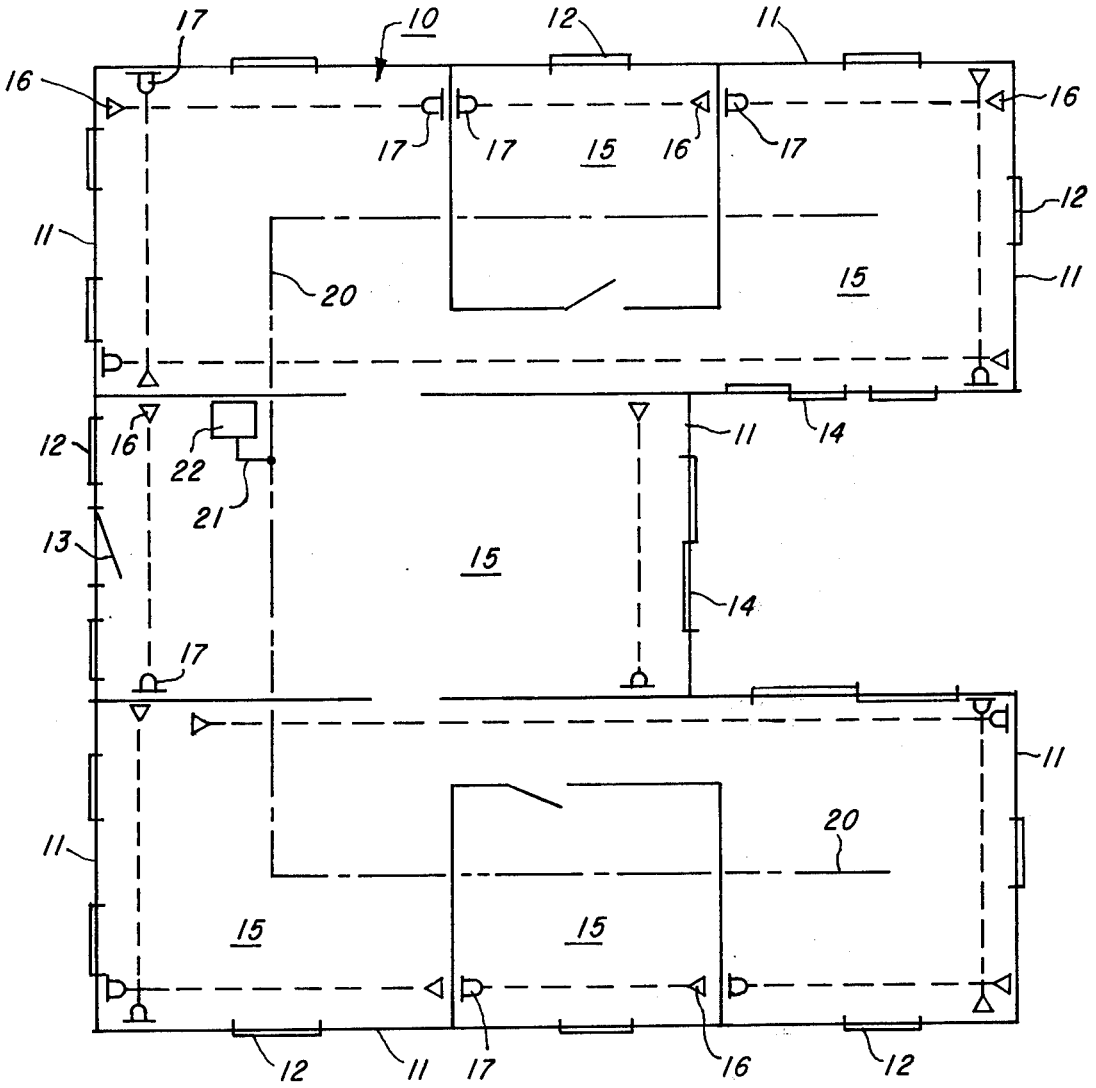
FIG. 1 is a plan view of a building having a surveillance system according to the invention.

Referring now to FIG. 1, a typical layout for an alarm system according to the invention is illustrated. A building 10 is shown which might be a residence, small business, school, etc. The building 10 has exterior walls 11 which have windows 12, doors 13 or sliding glass doors 14 in each of the various rooms 15. Typically, each room 15 would have at least one window or door on an exterior wall 11, each being a possible ingress by an unwanted intruder; some of the rooms 15 have two or three exterior walls 11, so points of ingress exist on two or three sides. This means that if a line-of-sight type of intrusion detector is used, then a large number of detectors are needed to completely protect the building. In the example of FIG. 1, fourteen separate pairs of emitter/detectors would be needed to cover all points of ingress. The cost of all of the emitter/detectors plus the wiring and installation costs and maintenance of all of these units could be prohibitive for homeowners or small businesses. Thus, according to the invention, sets of emitters and detectors are used which are very inexpensive and reliable, are easily installed with no wiring, and are coupled to a control alarm console with no individual wiring required.

In FIG. 1, sets of emitters 16 and detectors 17 are provided in each room 15 at each exterior wall 11 where an ingress point such as a window or door is present. Only one set is needed along one wall of a room, even though there may be two or three points of ingress on that particular wall. The emitters 16 produce a directive beam of energy which is preferably invisible to the naked eye, and which should not penetrate the walls of a typical building; that is, visible light would not be very suitable because the beam could be seen by an intruder and thus avoided, it might be objectionable to a person sleeping in a room at night, and it might be subject to interference with ambient light during the day. A beam of microwave energy, in addition to being more expensive to generate, could also penetrate the sheetrock walls of a typical residential building and interfere with the emitter/detector set in an adjacent room. Thus, in a preferred embodiment, the system uses infrared emitters 16 which have the advantages of producing an invisible beam which does not penetrate the walls, being relatively inexpensive, using low supply voltage at low power consumption, and having a very long reliable lifetime. The emitters 16 produce relatively narrow beams 18 which travel along a line-of-sight to the detectors 17. These detectors would preferably use cells which are responsive only to infrared; however, cells of this type are relatively expensive and perhaps require cooling or are otherwise not compatible with the system objectives. Accordingly, the detectors 17 as a practical compromise may use cells such as those made of mercury cadmium telluride or indium arsenide which are responsive to infrared light at room temperature, but are also somewhat responsive to visible light. The detectors would thus rely on directionality to avoid response to light from the sun or a tungsten lamp, for example.

Each of the detectors 17, in addition to having a cell responsive to the beam 18 from the emitter 16, also includes a transmitter which produces a signal which is altered in response to the receipt of the beam 18. That is, when the beam is broken, the signal emitted by the transmitter part of a detector 17 will be changed so that intrusion can be detected at a central location.

The transmitter outputs from the detectors 17 are detected by an antenna wire 20 which may be laid out in the attic or beneath the floor in the crawl space of the building. The antenna may be simply a single wire as shown, or perhaps a loop surrounding the perimeter of the building. In any event it is cheap and easily installed; individual connections to the detectors 17 are not needed. The antenna is connected by a wire 21 to a central control console 22 which functions to monitor the signals transmitted from all of the detectos 17 and produce an alarm or other indication when one of the beams 18 is interrupted. It is noted that the only wiring necessary upon installation of the system is the connection 21 between the antenna 20 and the control console 22; the wire 21 would have to pass through the ceiling, wall or floor to connect the antenna in the attic with the console box which would typically be located near the main exterior door of the building. The console 22 would usually have switches and timers so that the system could be turned on when the occupants left the building and turned off upon return; delay arrangements are needed to avoid the annoyance of causing the alarm to be sounded by the occupants leaving the building, or returning. In any event, it is preferable to have the console 22 near the main entrance door 13 so the controls can be conveniently reached by the occupants.

Figure 2:
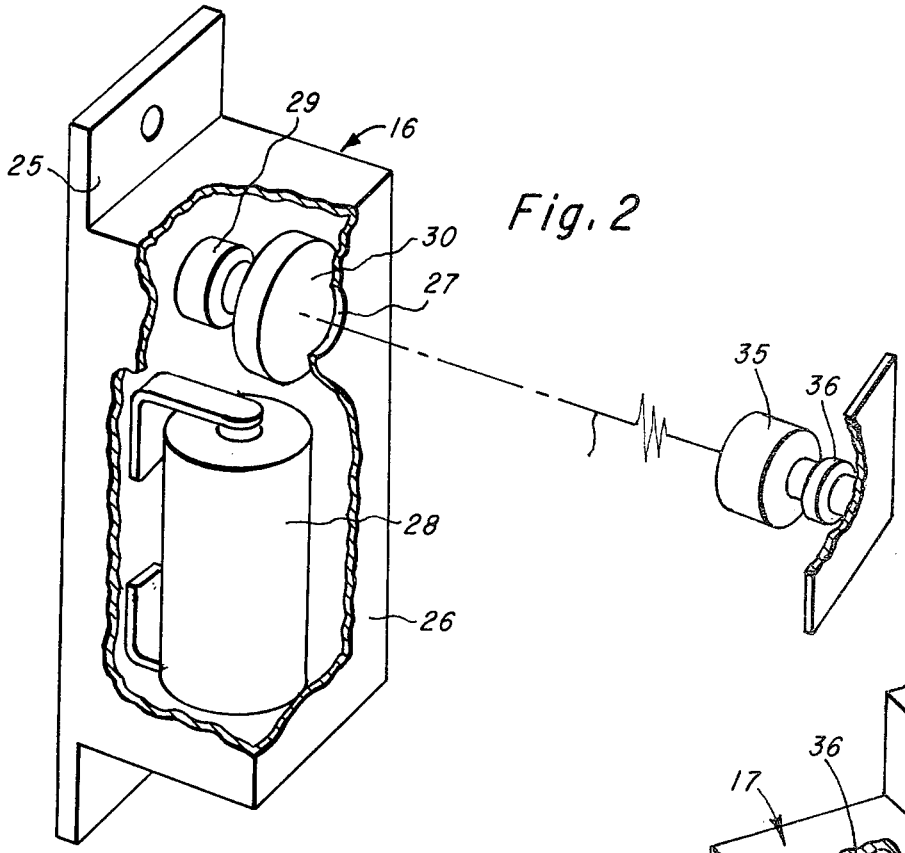
FIG. 2 is a pictorial view, partly broken away, of an emitter used in the system of FIG. 1.

Referring now to FIG. 2, there is shown one example of construction of one of the emitters 16. The unit is attached to the wall by a suitable bracket 25, using fastening means such as screws, tacks or adhesive. A removable housing 26 clips onto the bracket, and has an aperture 27 for the beam 18 to exit. Within the housing a battery 28 is mounted by suitable spring clips; this is preferably a small, inexpensive, non-rechargable or throw-away "penlight" cell. Connected across the battery is a radiation source 29 which may comprise a p-n junction gallium arsenide light source which emits infrared light when forward biased. Devices of this type are commercially available from Texas Instruments Incorporated, Dallas, Texas, under the trade designation TIL31, TIL32 or TIXL26, for example. These devices emit radiation generally in the 0.9 to 1.0 MM wavelength, compared to 0.5 to 0.6 MM for visible light; thus, the beam 18 is invisible to intruders. A lens 30 in front of the source 29 may be needed to focus or collimate the beam 18 so that sufficient intensity is obtained at the detector with low current drain on the battery 28. A resistor may be connected in series with the battery and diode 29 to limit forward current.

Figure 3:
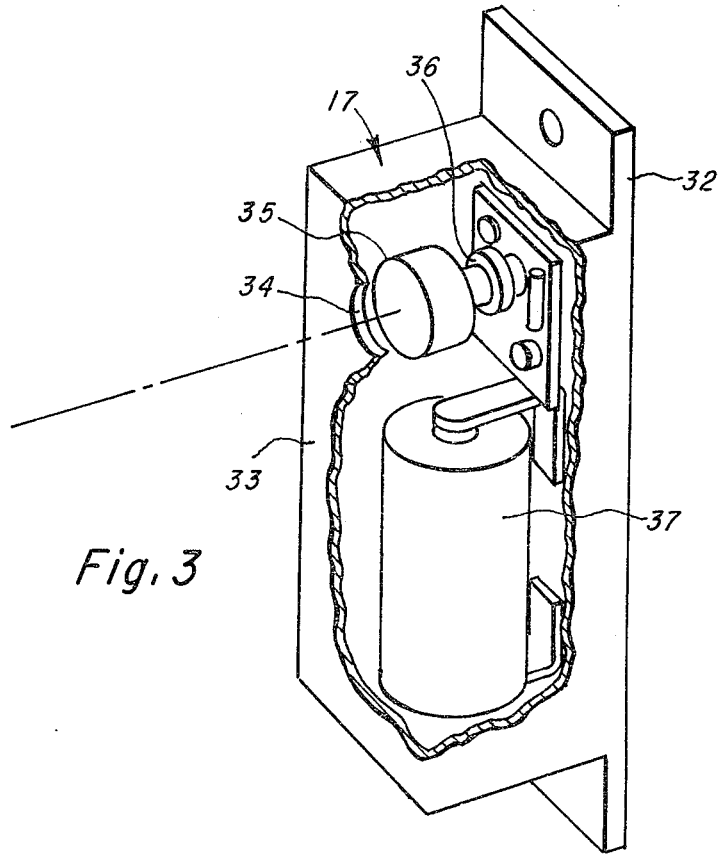
FIG. 3 is a pictorial view, partly broken away, of a detector used in the system of FIG. 1.

In FIG. 3, there is shown a pictorial view of a detector 17; this unit is the same as the emitter unit, with the exception of using a detector cell instead of a light emitter, and also it provides a transmitter circuit. A bracket 32 provides means for mounting the unit on the wall, and a housing 33 clips onto the bracket. The infrared beam enters an aperture 34 in the housing, and passes through a lens 35 if needed to concentrate the beam, to reach a detector cell 36. This cell may be a HgCdTe or InAs infrared detector cell. The cell 36 is mounted on a small circuit board with other components such as transistors which make up the transmitter circuitry. A small battery 37 such as a penlite cell provides the power supply for the detector cell and transmitter.

Figure 4:
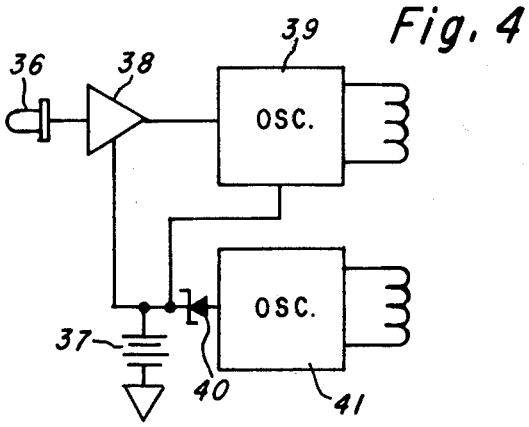
FIG. 4 is a block diagram of the detector of FIG. 3.

Referring to FIG. 4, the detector and transmitter circuitry in the detector unit 17 is shown in block diagram form. The output of the cell 36 is coupled through an amplifier 38 if needed, to an oscillator 39. The oscillator may be a simple one or two transistor circuit which oscillates at perhaps 100 KHz and which is responsive to an output from the detector 36; when the beam 18 is interrupted, an output voltage from the amplifier 38 causes a voltage responsive component in the oscillator circuit to alter the oscillator frequency, such as from 100 KHz to 80 KHz. The oscillator 39 drives a coil or small ferrite antenna. The battery 37 supplies operating voltage to the components of the circuit of FIG. 4; a low voltage detecting and signalling arrangement may include a threshold device such as a zener diode 40 along with another one-transistor oscillator 41. When the battery voltage decays to a certain level, the oscillator 41 will become unblocked or will turn on, and send out a signal at another frequency, e.g., 120 KHz. Alternatively, instead of using a separate oscillator 41, the other oscillator 39 might be caused to change in frequency in the opposite direction from the change which results from detecting an intruder.

Figure 5:
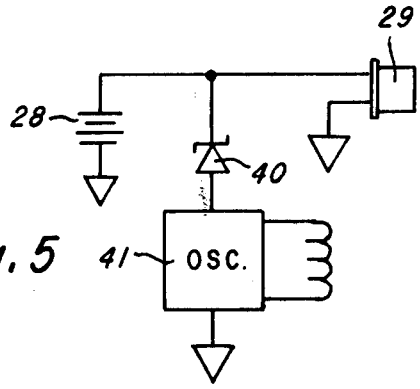
FIG. 5 is a block diagram of the emitter of FIG. 2.

Referring to FIG. 5, it is noted that the emitter unit 16 may also employ a low voltage detector and signalling circuit including a threshold detector 40 and an oscillator 41, to produce an indication at the central console that one of the batteries is down and should be replaced. When the voltage is low for one battery, all of the batteries would be replaced, since others would likely fail in a short time.

Figure 6:
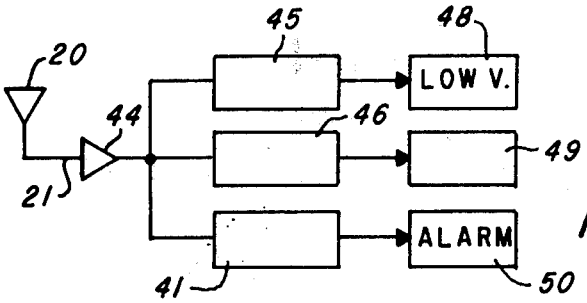
FIG. 6 is a block diagram of the control console in the system of FIG. 1.

With reference now to FIG. 6, the central console 22 is shown in block diagram form. Signals picked up by the antenna 20 are applied to an amplifier 44, and the amplified output is applied to three filters 45, 46 and 47. The filter 45 is sharply responsive to the low voltage indicator frequency, e.g., 120 KHz, and when an output is produced here it is used to drive a low voltage indicator device 46. This indicator device may be a lamp on the front panel of the central console. The filter 46 is responsive to the center frequency of the oscillators, and produces an output level which would decrease if one or more of the oscillators failed, as by failure of a component, excessive heat, tampering, etc. So, the output level is differentiated, and used to operate an indicator 49. The lower frequency detected by the filter 47 is used to actuate the primary alarm circuit 50 of the system. This may include a bell, a telephone dialer, flashing lights, etc. as outlined above.

Although this invention has been described with reference to illustrative embodiments, it is of course understood that this description is not to be construed in a limiting sense. Various modifications of the disclosed embodiments, as well as other embodiments of the invention, will appear to persons skilled in the art upon reading this description. It is therefore contemplated that the appended claims will cover any such modifications or embodiments as fall within the true scope of the invention.

What is claimed is:

1. A surveillance system comprising a plurality of pairs of emitters and detectors with each pair being effective to detect breaking of a beam between the emitter and detectors, each emitter being a small self-powered unit which may be installed on site without wiring connections, each emitter consisting essentially of a battery and a semiconductor GaAs radiant diode device producing infrared light, each detector including a solid state radiation-responsive device and a battery and transmitting a continuous wireless radio frequency signal which is altered in a first manner to a set frequency upon interruption of the beam, each detector including means for producing a radio frequency signal different from said set frequency when the voltage of its battery is low, a central control console including a receiver responsive to change in any of said signals from the detectors and adapted to produce an alarm or indication when any of said signals is altered.

2. A system according to claim 1 wherein the detectors are HgCdTe or InAs infrared detectors.

3. A system according to claim 1 wherein means are provided in the central console responsive to the signal of said different frequency to produce a low voltage indication.

4. An alarm system of the type having a plurality of pairs of emitter means and detection means, each pair of which monitors a specified area and transmits a wireless radio signal responsive to breaking a radiation beam between an emitter means and a detection means by an intruder in such area, each of the emitter means and detection means being a small self-powered unit which may be installed on site without wiring connections, each emitter means consisting essentially of a battery and a semiconductor radiant device, each detection means including a solid state radiation responsive device and a battery, each detection means also including means for transmitting radio signals of a different nature when the battery thereof is low, and a central alarm unit receiving radio signals from the detection means including means responsive to said wireless radio signal and said radio signals of different nature.

5. An alarm system according to claim 4 wherein the detection means are each responsive to a light beam from a separate emitter unit, the emitter units being also small, self-powered units which may be installed without wiring connections.

6. An alarm system according to claim 5 wherein the emitter units also include means for transmitting radio signals when the power supply thereof is low, and the central alarm unit is responsive thereto.

7. An alarm system according to claim 6 wherein the emitter units produce infrared light by P-N junction radiant diodes.

8. An alarm system according to claim 6 wherein radio signals of different frequencies are produced when an intruder is detected and when power supply is low.

* * * * *